US005527360A

United States Patent [19]

Birkhofer et al.

[11] Patent Number: 5,527,360

[45] Date of Patent: Jun. 18, 1996

[54] FATLIQUORING, FILLING AND HYDROPHOBICIZING LEATHERS AND FURS

[75] Inventors: Hermann Birkhofer; Peter Danisch, both of Ludwigshafen; Norbert Greif, Bobenheim; Knut Oppenlaender, Ludwigshafen, all of Germany

[73] Assignee: BASF Aktiengesellschaft, Ludwigshafen, Germany

[21] Appl. No.: 427,654

[22] Filed: Apr. 21, 1995

Related U.S. Application Data

[63] Continuation of Ser. No. 140,106, filed as PCT/EP93/00543, Mar. 10, 1993 published as WO93/19210, Sep. 30, 1993, abandoned.

[30] Foreign Application Priority Data

Mar. 21, 1992 [DE] Germany ..... 42 09 243.4

[51] Int. Cl.[6] ..... C14C 9/02

[52] U.S. Cl. ..... 8/94.23; 252/8.57; 8/94.21; 8/94.22

[58] Field of Search ..... 252/8.57; 8/94.21, 8/94.22, 94.33, 94.23

[56] References Cited

U.S. PATENT DOCUMENTS 2,892,673 6/1959 Heyden ..... 8/94.22

FOREIGN PATENT DOCUMENTS 1137945 6/1957 France ..... 8/94.22
3909614 9/1990 Germany .
791633 3/1958 United Kingdom .

OTHER PUBLICATIONS

Hawley's Condensed Chemical Dictionary, 11th Edition, 1987, p. 703.

Chemical Abstracts, vol. 53, No. 10, May 25, 1959, pp. 1958–1959, Abstract No. 9696g.

*Primary Examiner*—Prince Willis, Jr.
*Assistant Examiner*—Alan D. Diamond
*Attorney, Agent, or Firm*—Oblon, Spivak, McClelland, Maier & Neustadt

[57] ABSTRACT

A process for fatliquoring, filling and hydrophobicizing leathers and furs, comprises using ene adducts of maleic anhydride with unsaturated fatty acids of from 12 to 24 carbon atoms or their $C_1$- to $C_{20}$-alkyl or $C_2$- to $C_{20}$-alkenylesters, triglycerides, amides, mono- or di($C_2$- to $C_4$-alkanol)amides, mono- or dipolyetheramides or polyetheresters, or ene adducts partially or completely derivatized by reaction with amines or alcohols to form amides or esters, respectively.

8 Claims, No Drawings

FATLIQUORING, FILLING AND HYDROPHOBICIZING LEATHERS AND FURS

This application is a continuation of application Ser. No. 08/140,106, filed on Nov. 5, 1993, now abandoned, which is a 371 of PCT/EP93/00543, filed on Mar. 10, 1993.

The present invention relates to an improved process for fatliquoring, filling and hydrophobicizing leathers and furs and to an improved fatliquoring agent for leathers and furs.

To control the mechanical properties of leather such as softness, flexibility or suppleness it is common to use fat liquors, aqueous emulsions of in general petrochemically produced or natural oils and fats rendered water-emulsifiable by partial sulfonation or by means of emulsifiers or solubilizers.

This class of fat liquor ingredients has the disadvantages of incomplete liquor exhaustion, lack of resistance to extraction by solvents or water, migratory phenomena and unsatisfactory fastness profiles.

For instance, DE-A-39 09 614 (1) concerns a process for fatliquoring and hydrophobicizing leathers and furs by using sulfonated compounds of succinic acid with unsaturated fatty acids or esters, amides or alkanolamides, for example, the product of reacting oleic acid or an oleic acid derivative with maleic anhydride in the presence of a free radical initiator and subsequently sulfonating with sulfuric acid.

U.S. Pat. No. 3,656,881 (2) discloses that alkenyl-substituted saturated dibasic acids such as isooctadecenylsuccinic acid are suitable for softening leather. Here adequate solubility or emulsifiability is achieved using organic solvents as solubilizers. Since organic solvents are in general not bound by leather, this gives rise to ecological problems, in particular contamination of the waste water by residual liquors and of the air through evaporation during the drying process.

It is an object of the present invention to provide an improved product for fatliquoring, filling and hydrophobicizing leathers and furs that is free of the prior art disadvantages.

We have found that this object is achieved by a process for fatliquoring, filling and hydrophobicizing leathers and furs, which comprises using ene adducts of maleic anhydride with unsaturated fatty acids of from 12 to 24 carbon atoms or their $C_1$- to $C_{20}$-alkyl or $C_2$- to $C_{20}$-alkenyl esters, triglycerides, amides, mono- or di($C_2$- to $C_4$-alkanol)amides, mono- or dipolyetheramides or polyetheresters, or ene adducts partially or completely derivatized by reaction with amines or alcohols to form amides or esters, respectively.

The ene adducts mentioned are known in principle from (1) and from DE-C-27 54 831 (3). In (1) they are mentioned as intermediates in the synthesis of the sulfonated fatliquoring agents claimed therein, but are not recommended for use as leather treatment assistants in their own right. In (3) they are claimed as solubilizers for nonionic surfactants in alkaline aqueous solution.

The ene adducts are prepared in a conventional manner by a thermal addition of maleic anhydride to unsaturated fatty acids or derivatives thereof in which the unsaturated fatty acid, irrespective of its number of double bonds, adds per mole about 0.4–2 mol, preferably from 0.7 to 1 mol, of maleic anhydride. The addition can be carried out for example in boiling toluene or without a solvent at from 100° to 200° C., preferably in the presence of catalytic amounts of iodine. The unsaturated fatty acids have from 12 to 24, preferably from 14 to 18, carbon atoms and one or more olefinic double bonds. The amount of maleic anhydride added per double bond is preferably not more than one mole, although more could be added, since only the double bond from maleic anhydride is used up in the addition and not that of the fatty acid. Examples of suitable unsaturated fatty acids [are] in particular oleic acid (cis-9,10-octadecenoic acid), but also the corresponding transisomer elaidic acid, lauroleic acid (9,10-eicosenoic acid), erucic acid (13,14-docosenoic acid) and selacholeic acid (15,16-hexadecenoic acid). Examples of suitable fatty acids having two or more olefinic double bonds are in particular linoleic acid (9,10-12,13-octadecadienoic acid) and linolenic acid (9,10-12,13-15,16-octadecatrienoic acid).

It is also possible to use the circumscribed esters of the unsaturated fatty acids mentioned, eg. methyl, ethyl, propyl, butyl, 2-ethylhexyl, decyl, dodecyl, tetradecyl, hexadecyl, stearyl, hexadecenyl, oleyl, linoleyl and linolenyl esters.

In addition to the circumscribed monoesters it is also possible to use the triglycerides of the unsaturated fatty acids, ie. especially natural fats and in particular oils, which contain predominant proportions, ie. more than 50 mol %, preferably more than 75 mol %, based on the fatty acid total present in the mixture, of the aforementioned unsaturated fatty acids as esters. Suitable examples are linseed oil, olive oil, castor oil, ground-nut oil, sesame seed oil, corn seed oil, sunflower oil, soybean oil, poppy seed oil, cotton seed oil, hemp seed oil and palm kernel oil and also the various animal fats and in particular oils such as fish oil, whale oil and sperm oil. The last one contains not only glycerides but also appreciable amounts of esters with wax alcohols, including unsaturated alcohols.

Suitable fatty acid amides are in particular the compounds which are unsubstituted at the amide nitrogen.

Suitable mono- or di($C_2$- to $C_4$-alkanol)amides are in particular N-monoethanolamide, N,N-diethanolamide, N-monoisopropanolamide and N,N-diisopropanolamide.

Examples of suitable mono- or dipolyetheramides are compounds that are substituted at the amide nitrogen by polyoxyethylene groups having a respective degree of ethoxylation of from 1 to 30, in particular from 2 to 20.

Examples of suitable polyetheresters are the reaction products of unsaturated fatty acids with from 1 to 30 mol, in particular from 2 to 20 mol, of ethylene oxide.

The preparation of the amide or ester derivatives is effected in a known manner by addition of the amine or alcohol to the anhydride group-containing ene adduct at temperatures between customarily 20° and 200° C., preferably between 50° and 150° C. The addition can be catalyzed, for example with p-toluenesulfonic acid. Per mole of anhydride group it is preferable to use not more than one mole of amine or alcohol. The addition can be carried out for example in toluene or in the absence of a solvent, preferably in the same reaction medium as used in the preparation of the ene adduct. For instance, the alcohols used can be for example methyl, ethyl, propyl, butyl, 2-ethylhexyl, decyl, dodecyl, tetradecyl, hexadecyl, stearyl, oleyl alcohol or alkoxylated fatty or oxo alcohols or carbohydrates such as, for example, glucose. Preference is given to using straight-chain or branched $C_1$-$C_{20}$-alkanols, in particular $C_4$-$C_{18}$-alkanols, and also to $C_8$-$C_{18}$-alkanols reacted with from 2 to 20 mol of ethylene oxide and/or propylene oxide per mole of alkanol. The amines used can be for example mono- or di-N-alkylamines such as n-butylamine, 2-ethylhexylamine, morpholine, piperidine or tallowamine or amino acids such as sarcosine, taurine or iminodiacetic acid or amino alcohols such as iminodiethanol or hydroxyethylamine. Preference is given to using saturated or unsaturated secondary or in particular primary aliphatic amines having a total of from 1 to 30, in particular from 4 to 18, carbon atoms.

In a preferred embodiment the ene adducts used of maleic anhydride are with unsaturated fatty acids of from 14 to 18 carbon atoms or their $C_{14}$- to $C_{18}$-alkenyl esters or triglycerides, but in particular with oleic acid, oleyl oleate or a triglyceride containing more than 50 mol % of unsaturated fatty acids of from 14 to 18 carbon atoms, based on total fatty acid present in the mixture, as esters, or ene adducts derivatized partially or completely by reaction with aliphatic amines having in total from 1 to 30 carbon atoms or with $C_1$-$C_{20}$-alkanols or with alkoxylated alcohols to form amides or esters, respectively.

On being dissolved in an aqueous alkaline medium, the anhydride groups still present on the added maleic anhydride hydrolyze to form carboxylate groups, which, together with original carboxyl groups of unsaturated fatty acids that are likewise still in the salt form, ensure the solubility of the products to be used according to the invention.

The ene adducts described make it possible to produce very soft leathers without conventional fat liquors. This advantage is reflected in simple and short application recipes.

In addition to improving the mechanical properties, for example the breaking strength, these ene adducts bring about a distinct enhancement in the softness profile of the leather.

As well as improving the mechanical properties, for example the tensile strength, these ene adducts bring about a distinct enhancement in the fastness profile of the leather.

For instance, they have a very positive effect on the light fastness and the thermal yellowing resistance of such leathers. In addition to producing a virtually quantitative exhaustion of the liquor, the high yield of fixation in the leather results in resistance to extraction by solvent or water. This results in washable leathers, ie. leathers which on washing do not lose their properties such as softness, firmness and suppleness, unlike leathers fatliquored with conventional fat liquors.

As well as a softening effect, the products described also have a hydrophobicizing effect, ie. leathers and furs which have been treated therewith are water-repellent and absorb only minimal amounts of water.

A further advantage of the aqueous ene adduct emulsions to be used according to the invention is that they do not contain additional emulsifiers. As will be known, leathers and furs treated with emulsifier-containing products must afterwards be subjected to expensive processes, for example aftertreatment with polyvalent metal salts, in order to render the emulsifiers in the leather or fur skin, where they have a negative effect on the water repellency, ineffective.

The present invention also provides leather and fur fatliquoring, filling and hydrophobicizing compositions comprising the above-described ene adducts of maleic anhydride with unsaturated fatty acids or derivatives thereof.

The leather treatments of the invention are suitable for any conventional tanned hide. Tanned hides are customarily neutralized prior to the treatment. They may have already been dyed prior to the treatment. However, dyeing may also be delayed until after the treatment according to the invention.

The tanned hides are advantageously treated with the aqueous emulsions of the ene adducts in an aqueous liquor obtainable by diluting the emulsions with water at pH 4–10, preferably pH 5–8, and 20°–60° C., preferably 30°–50° C., for 0.1–5 hours, in particular 0.5–2 hours. This treatment may take the form for example of drumming. The amount of emulsion required is, based on the shaved weight of the leather or the wet weight of the fur skin, from 0.1 to 30% by weight, preferably from 1 to 20% by weight.

The liquor length, ie. the percentage weight ratio of treatment liquor to goods, based on the shaved weight of the leather or the wet weight of the fur skin, is customarily from 10 to 1000%, preferably from 30 to 150% in the case of leathers and from 50 to 500% in the case of fur skins.

After the treatment with the above-described aqueous liquor, the pH of the treatment liquor is adjusted with acids, preferably organic acids, eg. formic acid, to pH 3–5, preferably pH 3.5–4.

If customary retanning agents are additionally employed in the finishing of the leather or fur skin, the treatment with the aqueous emulsion of the ene adducts can be carried out before or after the retanning operation.

EXAMPLES

The percentages in the Examples are by weight, unless otherwise stated. Preparation of aqueous ene adduct emulsions

EXAMPLE 1

240 g of oleic acid (hydrogenation iodine number 90.1) and 108 g of maleic anhydride were heated together in a nitrogen atmosphere at 200° C. for 4.5 hours. Unconverted maleic anhydride was then distilled off (26 g) under a water jet vacuum, leaving 320 g of product.

To 57 g of the oleic acid-ene adduct were added 12 g of 50% strength NaOH in 172 g of water to obtain a 25% strength brown emulsion.

EXAMPLE 2

Example 1 was followed to react 348 g of ester oil (hydrogenation iodine number 112.6) with 166 g of maleic anhydride. This resulted in 535 g of product, leaving 13 g of unconverted maleic anhydride.

To prepare an emulsion 24 g of 50% strength NaOH in 295 g of water were added to 97 g of ene adduct.

EXAMPLE 3

Example 1 was followed to react 375 g of capellan oil (hydrogenation iodine number 122) with 176 g of maleic anhydride. This resulted in 540 g of product leaving 10 g of unconverted maleic anhydride.

To prepare an emulsion 92 g of the ene adduct were dissolved in 24 g of 50% strength NaOH in 279 g of water.

EXAMPLE 4

Example 1 was followed to react 266 g of oleyl oleate (hydrogenation iodine number 95.5) with 127 g of maleic anhydride. This resulted in 365 g of product, leaving 20 g of unconverted maleic anhydride.

To prepare an emulsion 66 g of the ene adduct were dissolved in 75 g of 50% strength NaOH in 197 g of water.

EXAMPLE 5

To 114 g of the capellan oil-ene adduct of Example 3 were added 6.2 g of n-butylamine at from 70° to 80° C. 120 g of product were obtained after three hours at 80° C.

To prepare an emulsion 100 g of product were added to 300 g of water and 16 g of 50% strength sodium hydroxide solution.

EXAMPLE 6

To 88 g of the capellan oil-ene adduct of Example 3 were added 33.2 g of n-tallowamine at from 70° to 80° C. 121 g of product were obtained after three hours at 80° C.

To prepare an emulsion 100 g of product were added to 300 g of water and 10.5 g of 50% strength sodium hydroxide solution.

EXAMPLE 7

To 107 g of the capellan oil-ene adduct of Example 3 were added 0.6 g of p-toluenesulfonic acid at from 70° to 80° C. 14.1 g of isobutanol were added at from 120° to 130° C. 119 g of product were obtained after three hours at 130° C.

To prepare an emulsion 100 g of product were added to 300 g of water and 10 g of 50% strength sodium hydroxide solution.

EXAMPLE 8

To 40.5 g of the capellan oil-ene adduct of Example 3 were added 0.6 g of p-toluenesulfonic acid at from 70° to 80° C. 81.6 g of a commercial mixture of $C_{12}$-$C_{15}$-salkanols which had been reacted with ethylene oxide and propylene oxide (together about 9 mol per mole of alkanol) were added at from 120° to 130° C. 122 g of product were obtained after three hours at 130° C.

To prepare an emulsion 100 g of product were added to 300 g of water and 3.5 g of 50% strength sodium hydroxide solution.

Use in leathermaking

EXAMPLE 9

Chrome tanned cattlehide leather which had a shaved thickness of 1.8 mm and had been adjusted to a pH of 5.0 was drummed at 40° C. for 2 hours with an amount of the emulsion of Example 1 to correspond to 15% of active ingredient, based on the shaved weight. The total liquor length was 150%. The leather was then dyed with 1% by weight of a conventional anionic aniline dye. It was then adjusted to pH 3.8 with formic acid and finally washed, mechanically set out and dried.

The leather obtained was very soft, supple, highly filled and uniform in color.

EXAMPLE 10

Chrome tannned cattlehide leather which had a shaved thickness of 1.8 mm and had been adjusted to a pH of 5.0 and dyed with 0.7% by weight of a conventional anionic aniline dye was drummed at 40° C. for 1.5 hours with an amount of the emulsion of Example 2 to correspond to 20% of active ingredient, based on shaved weight. Thereafter the leather was adjusted with formic acid to pH 3.6 and finished in a conventional manner.

The leather thus obtained was very soft and pliable.

EXAMPLE 11

Chrome tanned cattlehide leather which had a shaved thickness of 1.8 mm and had been adjusted to pH 5.0 and dyed with 0.7% of a conventional anionic aniline dye was drummed at 40° C. for 30 minutes with an amount of the emulsion of Example 3 corresponding to 15% of active ingredient, based on shaved weight, and then further treated with 3% of a conventional synthetic tanning agent for one hour. The leather was then adjusted with formic acid to pH 3.6 and finished in a conventional manner.

The leather thus obtained had a pleasantly soft and pliable feel.

EXAMPLE 12

The emulsion of Example 4 was used in the manner of Example 9.

The leather thus obtained had soft and round hand properties.

EXAMPLE 13

The emulsion of Example 5 was used in the manner of Example 9.

The leather thus obtained had soft and pleasant hand properties.

EXAMPLE 14

The emulsion of Example 6 was used in the manner of Example 9.

The leather obtained was soft with a slightly creamy hand. No water penetration occurred in the course of 12 hours in the penetrometer under 10% compression.

EXAMPLE 15

The emulsion of Example 7 was used in the manner of Example 9.

The leather thus obtained was pleasantly soft and pliable.

EXAMPLE 16

The emulsion of Example 8 was used in the manner of Example 9.

The leather obtained had a pleasantly soft hand and a uniform coloring.

We claim:

1. A process for fat-liquoring, filling and hydrophobicizing leathers and furs, which consists essentially of:

contacting a leather or fur with an ene adduct selected from the group consisting of:

(a) an ene adduct of maleic anhydride and a compound selected from the group consisting of a $C_{1-20}$ alkyl ester of a $C_{12-24}$ unsaturated fatty acid, a $C_{2-20}$ alkenyl ester of a $C_{12-24}$ unsaturated fatty acid, a triglyceride containing a $C_{12-24}$ unsaturated fatty acid, a $C_{12-24}$ unsaturated fatty acid amide, a $C_{12-24}$ unsaturated fatty acid $C_{2-4}$ alkanol amide, a $C_{12-24}$ unsaturated fatty acid di-$C_{2-4}$ alkanol amide and a $C_{12-24}$ unsaturated fatty acid polyether amide;

(b) an ene adduct according to (a) which is partially or completely derivatized by reaction with an amine to form an amide; and (c) an ene adduct according to (a) which is partially or completely derivatized by reaction with an alcohol to form an ester.

2. The process of claim 1, wherein said ene adduct is selected from the group consisting of:

an ene adduct of maleic anhydride and a compound selected from the group consisting of a $C_{14-18}$ a alkenyl ester of a $C_{14-18}$ unsaturated fatty acid and a triglyceride containing a $C_{14-18}$ unsaturated fatty acid;

an ene adduct according to (a), which is partially or completely derivatized by reaction with a $C_{1-30}$ aliphatic amine;

an ene adduct according to (a), which is partially or completely derivatized by reaction with a $C_{1-20}$ alkanol; and an ene adduct according to (a), which partially or completely derivatized with an alkoxylated alcohol.

3. The process of claim 1, wherein said ene adducts are formed from maleic anhydride and a compound selected from the group consisting of oleyl oleate and a triglyceride containing up to 50 mol % of $C_{14-18}$ unsaturated fatty acids, based on the total fatty acid present in the triglyceride.

4. The process of claim 1, wherein said leather or fur is in the form of a tanned hide and said adduct is in the form of an aqueous emulsion.

5. The process of claim 4, wherein said leather or fur is contacted with an aqueous emulsion of said ene adduct in water at a pH of 4 to 10 and at a temperature of 20° to 60° C. for about 0.1 to 5 hours.

6. The process of claim 5, wherein said leather or fur is contacted with an aqueous emulsion of said ene adduct in water at a pH of 5 to 8 and at a temperature of 30° to 50° C. for about 0.5 to 2 hours.

7. The process of claim 4, wherein the emulsion is used in an amount of from 0.1 to 30% by weight based on the weight of the tanned hide.

8. The process of claim 4, wherein said tanned hide is a chrome tanned cattlehide.

* * * * *